United States Patent [19]

Hoshino

[11] Patent Number: 4,581,972

[45] Date of Patent: Apr. 15, 1986

[54] PAD FOR ELECTRONIC DRUM

[75] Inventor: Yoshiki Hoshino, Owariasahi, Japan

[73] Assignee: Hoshino Gakki Co., Ltd., Japan

[21] Appl. No.: 665,781

[22] Filed: Oct. 29, 1984

[30] Foreign Application Priority Data

Mar. 31, 1984 [JP] Japan ..... 59-047785

[51] Int. Cl.[4] ..... G10D 13/02; G10H 3/12

[52] U.S. Cl. ..... 84/1.14; 84/411 P; 84/465; 84/DIG. 12

[58] Field of Search ..... 84/1.04, 1.06, 1.14–1.16, 84/411 R, 411 P, 465, DIG. 12

[56] References Cited

U.S. PATENT DOCUMENTS 3,264,926 8/1966 Belli .
3,509,264 4/1970 Green .
3,597,520 8/1971 Andrews .
3,956,959 5/1976 Ebihara et al. ..... 84/1.15
4,279,188 7/1981 Scott .
4,479,412 10/1984 Klynas ..... 84/1.04

*Primary Examiner*—Stanley J. Witkowski
*Attorney, Agent, or Firm*—Ostrolenk, Faber, Gerb & Soffen

[57] ABSTRACT

A pad for an electronic drum has a vibration responsive plate that is mounted on a cushion and has on its upper surface a relatively thin buffer pad, the plate having cushioning means on its outer edge between it and peripheral supporting structure, so that the feel of the drumhead is quite natural to the player and that vibrations from the frame or supporting structure are insulated from the plate, and that the plate vibrations are not adversely affected, the plate carrying a microphone or other sound pick-up means.

5 Claims, 4 Drawing Figures

PAD FOR ELECTRONIC DRUM

BACKGROUND OF THE INVENTION

1. Field of the Invention

This invention relates to musical instruments, more particularly those of the percussive type in which the sound is picked up by a microphone mounted on the instrument, itself. It further relates to a drum pad in which the conventional head may be omitted, but in which the construction and arrangement of the elements is such as to simulate the natural feel of a conventional head.

2. Description of the Prior Art

Drum practice pads which include relatively rigid support structure and cushion members thereover have been provided in the past as for example in the patent to Belli No. 3,264,926, and Andrews No. 3,597,520. However, these were intended merely for practice purposes rather than for performance and do not disclose any means for amplification.

The patent to Green No. 3,509,264 discloses what appears to be a conventional drumhead having a sound amplifier connected thereto. The patent to Scott No. 4,279,188 discloses a practice pad in which an electromechanical transducer is substantially contiguous with the drumhead, and in which a speaker cone type pick-up is installed on the base of the body in order to pick-up the vibrations generated by hitting the drumhead.

SUMMARY OF THE INVENTION

A drum pad in accordance with the present invention has a relatively rigid plate member which is responsive to the vibrations received from being struck by the instruments used by the player of the drum, in which the plate is mounted on an appropriately supported cushion member and has an overlying buffer pad, the plate being mounted so that it is spaced away from a side retaining wall by a cushioning element thereby insulating the plate from vibrations that otherwise may be transmitted from the supporting structure and at the same time providing a pad that has a natural feel for the player.

DESCRIPTION OF THE PREFERRED EMBODIMENT

Figure 1:
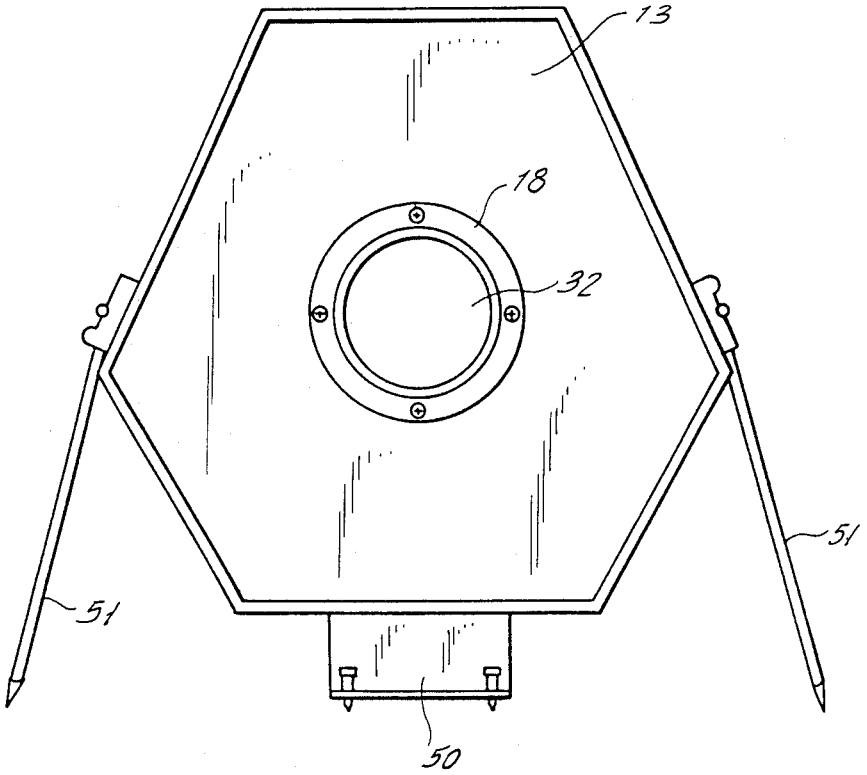
FIG. 1 is a front view of a pad and supporting structure of a drum in accordance with the present invention.
Figure 2:
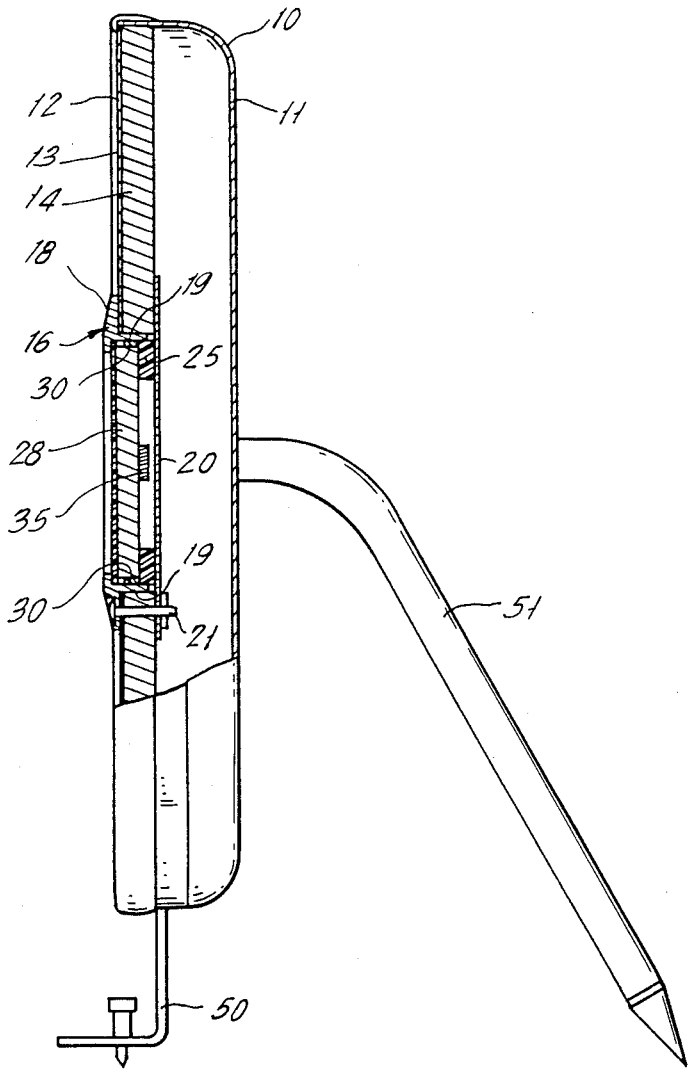
FIG. 2 is a side view, partially in section, of the structure of FIG. 1.
Figure 3:
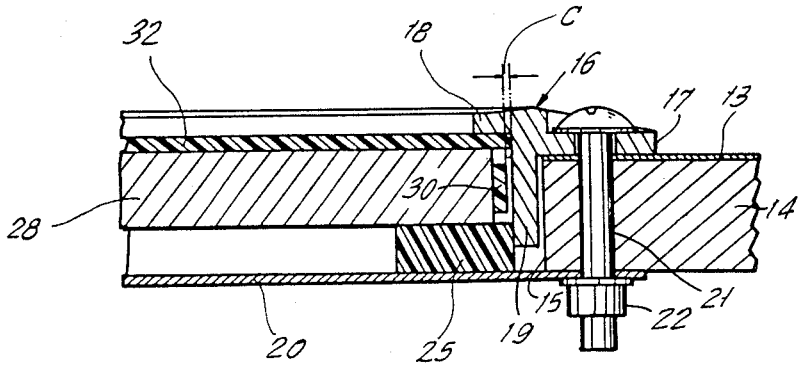
FIG. 3 is an enlarged fragmentary section of the pad.

With further reference to FIGS. 1–3 a drum pad with mounting structure is illustrated and includes a main support body 10, having a rear generally dish-shaped housing member 11 and a front panel 12. The front panel has a relatively thin outer surface cover 13 and a core portion 14 of substantial thickness.

Panel 12 has a central opening 15 which may be circular, as indicated in the drawing, for receiving the drum pad and its supporting and retaining structure.

In order to retain the pad within the opening a cover member 16 is provided having an outer ledge portion 17 which rests over the inner rim of the panel 12, and an inner flange portion 18 which overlies the outer rim portion of the pad, as will be described, and a depending portion 19 which provides a retaining wall for the pad.

The pad includes a lower support member 20 which extends outwardly beneath the inner edge of the panel 12 and is connected to it by fastening means 21, 22 which extend through the member 12 and the outer flange portion 17 of the cover 16 to hold the elements in assembled relationship.

Mounted directly above the support 20 is a cushion 25, of polyurethane foam or the like, which is relatively thick and is preferably ring shaped, although such ring may be of disconnected spaced segments, if desired, to enhance the cushioning effect. The outer rim of the cushion abuts the inner surface of the depending portion 19 of the cover 16.

Mounted directly above the cushion is a plate member 28 which is relatively thick and rigid and of material such as a fiberboard veneer, which is responsive to the vibrations received from the instruments used by the player. The plate member 28 is substantially circular and of a diameter less than that of the inner surface of the depending portion 19 of the cover 16 so that the outer edge of the plate member is in spaced relation from the portion 19. A cushioning element 30 is mounted in such space and preferably is adhered onto the outer rim of the plate member 28 centrally between its upper and lower side edges. Element 30 may, if desired, be formed of disconnected spaced segments.

On the upper surface of the plate member 28 a relatively soft buffer pad 32 is provided and its outer edge preferably extends into abutting engagement with the inner surface of the depending portion 19 of cover member 16 and beneath the flange portion 18. The thickness of the pad 32 is preferably in the range of two to five millimeters.

The cushioning member 30 is preferably of such thickness as to be spaced from the inner surface of the depending member 19. In practice a gap of approximately one millimeter has been preferred.

Figure 4:
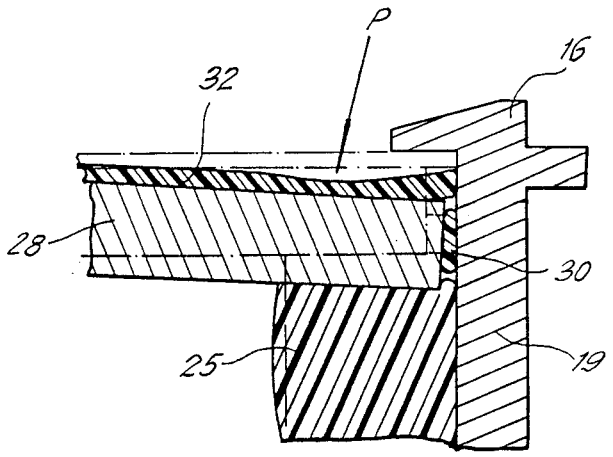
FIG. 4 is a further enlarged fragmentary section illustrating the pad during playing when the plate is tilted.

As a result of the mounting and the spacing of the plate 28 from the cover 16 and particularly its depending wall 19 the cushioning element 30 prevents contact between the plate and the cover even in the case when the plate is tilted, as indicated in FIG. 4, by a strong beating force P. Thus, vibrations which may otherwise be transmitted from the external support structure are avoided. Further, the vibrations in the plate are not adversely affected nor transmitted to the rigid support structure due to direct contact with the cover which would occur in the absence of the cushioning element 30. In addition, due to the firm mounting of the plate 28 on the cushion 25 and the provision of the cushioning element 30 the vibrations in the plate are accurately transmitted to the microphone, described below.

The overall structure makes it possible to produce accurately and with fine shading the player's beating vibrations, thereby providing improved functional advantages as compared with conventional products.

Mounted on the lower surface of the plate member 28 and preferably centrally thereof is a microphone 35 or other sound pick-up device which is connected by conventional means to an amplifier (not shown).

By way of illustration a supporting stand is illustrated including a lower support bracket 50 and legs 51.

I claim:

1. A drum pad for mounting on a support comprising a base member having outer wall means, first cushion means mounted on the base means and inwardly of said wall means, a relatively hard and rigid plate member mounted on the cushion means, said plate member having an outer peripheral edge spaced inwardly of said wall means, sound pick-up means mounted on said plate member, a relatively soft pad overlying the plate member, and second cushion means positioned in the space between said outer peripheral edge of said plate member and said wall means.

2. The invention of claim 1, in which said first cushion means extends around the peripheral portion of said base member and is open in its center.

3. The invention of claim 2, in which said first cushion means comprises spaced cushion elements.

4. The invention of claim 1, in which said plate member has substantial thickness providing upper and lower side edges, and said second cushion means is mounted on the outer peripheral edge of said plate member substantially midway of said upper and lower side edges.

5. The invention of claim 1, in which said base has cover means holding said pad and said plate on said base.

* * * * *